US009020104B2

(12) United States Patent
Iizuka et al.

(10) Patent No.: US 9,020,104 B2
(45) Date of Patent: Apr. 28, 2015

(54) X-RAY OPTICAL APPARATUS AND ADJUSTING METHOD THEREOF

(71) Applicant: Canon Kabushiki Kaisha, Tokyo (JP)

(72) Inventors: Naoya Iizuka, Utsunomiya (JP); Mitsuaki Amemiya, Saitama (JP); Akira Miyake, Nasukarasuyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 255 days.

(21) Appl. No.: 13/785,178

(22) Filed: Mar. 5, 2013

(65) Prior Publication Data

US 2013/0243164 A1 Sep. 19, 2013

(30) Foreign Application Priority Data

Mar. 14, 2012 (JP) ..... 2012-056843

(51) Int. Cl.
*G21K 1/06* (2006.01)

(52) U.S. Cl.
CPC ..... *G21K 1/062* (2013.01); *G21K 1/067* (2013.01); *G21K 1/06* (2013.01); *G21K 2201/064* (2013.01)

(58) Field of Classification Search
CPC ..... G21K 1/02; G21K 1/06; G21K 1/062; G21K 1/067; G21K 5/04; G21K 7/00; G21K 2201/06; G21K 2201/067; H05G 1/02
USPC ..... 378/147, 149
See application file for complete search history.

(56) References Cited

U.S. PATENT DOCUMENTS 3,143,651 A * 8/1964 Giacconi et al. ..... 378/43
4,827,436 A * 5/1989 Sabersky et al. ..... 250/559.36
5,001,737 A * 3/1991 Lewis et al. ..... 378/147
5,192,869 A * 3/1993 Kumakhov ..... 250/505.1
5,340,992 A * 8/1994 Matsugu et al. ..... 250/548
5,570,408 A 10/1996 Gibson ..... 378/145
6,266,392 B1 7/2001 Fujinawa et al. ..... 378/149
6,479,818 B1 * 11/2002 McCarthy et al. ..... 250/310
7,158,608 B2 * 1/2007 Kucharczyk ..... 378/71

(Continued)

FOREIGN PATENT DOCUMENTS

JP H10-508947 9/1998
JP 2000-137098 5/2000
JP 2004-089445 3/2004

OTHER PUBLICATIONS

U.S. Appl. No. 13/778,780, filed Feb. 27, 2013.

(Continued)

*Primary Examiner* — Thomas R Artman
(74) *Attorney, Agent, or Firm* — Fitzpatrick, Cella, Harper & Scinto

(57) ABSTRACT

The present invention provides a method of adjusting an X-ray optical apparatus which includes: an X-ray source; and a reflective structure where at least three reflective substrate arranged with an interval and X-rays which are incident into a plurality of passages whose both sides are put between the reflective substrates are reflected and parallelized by the reflective substrate at both sides of each passage to be emitted from the passage. When one edge of the reflective structure is an inlet of the X-ray and the other edge is an outlet of the X-ray, a pitch of the reflective substrates at the outlet side is larger than a pitch at the inlet side. The method comprises adjusting the relative positions of the X-ray source and the reflective structure so as to reduce a penumbra amount formed by the X-ray emitted from each of the passages.

12 Claims, 14 Drawing Sheets

(56) References Cited

U.S. PATENT DOCUMENTS

| | | | | |
|---|---|---|---|---|
| 7,397,900 | B2 * | 7/2008 | Papaioannou et al. | 378/147 |
| 7,742,566 | B2 | 6/2010 | Hopkins et al. | 378/84 |
| 2013/0243163 | A1 * | 9/2013 | Masaki et al. | 378/138 |
| 2013/0243164 | A1 * | 9/2013 | Iizuka et al. | 378/147 |

OTHER PUBLICATIONS

U.S. Appl. No. 13/783,520, filed Mar. 4, 2013.
U.S. Appl. No. 13/791,070, filed Mar. 8, 2013.

* cited by examiner

X-RAY OPTICAL APPARATUS AND ADJUSTING METHOD THEREOF

BACKGROUND OF THE INVENTION

1. Field of the Invention

The present invention relates to an X-ray optical apparatus that radiates an X-ray onto an object, and particularly to an X-ray optical apparatus in which a relative position of an X-ray source and an optical element is optimized and an adjusting method thereof.

2. Related Background Art

A technology that one-dimensionally parallelizes an X-ray using an optical element has been known. Japanese Patent Application Laid-Open No. 2000-137098 discloses a solar slit including metal foils which are disposed in an X-ray passage and laminated with an interval. Further, it is disclosed that a surface of a metal foil is formed to have a surface roughness to restrict the reflection of X-rays in order to form a parallel X-ray beam.

Japanese Patent Application Laid-Open No. 2004-89445 discloses an X-ray generating device in which a collimator in which a plurality of minute capillaries is two-dimensionally arranged is combined with multiple X-ray sources which are arranged in a two-dimensional matrix to parallelize an X-ray.

Japanese Patent Application Publication (Translation of PCT Application) No. H10-508947 discloses an optical system in which a divergence X-ray which is emitted from an X-ray source having a small spot size is efficiently captured in a monolithic optical element that includes a plurality of hollow glass capillaries to form a quasi-parallel beam.

In the optical element disclosed in Japanese Patent Application Laid-Open No. 2000-137098, since only a parallel component of the X-ray is taken, only a very small part of generated X-ray is used, so that the usage efficiency is low.

In the optical element disclosed in Japanese Patent Application Laid-Open No. 2004-89445, it is difficult to form uniform capillaries. Further, it is difficult to two-dimensionally arrange X-ray sources with a high density.

In the optical element disclosed in Japanese Patent Application Publication (Translation of PCT Application) No. H10-508947, the hollow glass capillaries fused together and plastically shaped. Therefore, it is difficult to form uniform capillaries.

Therefore, an optical element with a simple structure that efficiently parallelizes the generated X-ray to be emitted is required.

Further, a relative position of the X-ray source and the optical element is important in order to obtain an X-ray with a high intensity and a high resolution. In the technology disclosed in Japanese Patent Application Laid-Open No. 2000-137098, the alignment of the relative position of the X-ray source and the optical element is performed so as to maximize the intensity of the X-ray which passes the solar slit. For example, in FIG. 16, if the X-ray source is moved in a y direction, when the X-ray source 1 is disposed in a range indicated by a dotted line, the intensity of the X-ray which passes the solar slit 31 is maximized and the intensity is not changed. An angular width $\alpha$ is hardly changed, so that the resolution of the image is less affected. In the meantime, if the X-ray source 1 deviates from the range of the dotted line, the intensity of the X-ray is lowered. Accordingly, an alignment method that maximizes the intensity of the X-ray as described above is applied.

However, in the above-mentioned alignment method, if the relative position of the X-ray source and the optical element is deviated from the design, even though the deviation is negligible and does not lower the intensity of the X-ray, the resolution of the image is lowered in some cases. Further, even if other optical element of the related art is used, the resolution of the image is lowered in some cases when using the alignment method.

The invention provides an X-ray optical apparatus which is capable of efficiently parallelizing the generated X-ray to be emitted with a simple structure and improving the resolution of the image and an adjusting method thereof.

SUMMARY OF THE INVENTION

According to the present invention there is a method of adjusting an X-ray optical apparatus, the X-ray optical apparatus including an X-ray source and a reflective structure in which at least three reflective substrates are arranged with an interval and X-rays which are incident into a plurality of passages, both sides of each passage being put between the reflective substrates, are reflected and parallelized by the reflective substrate at both sides of the passage to be emitted from the passage. When one edge of the reflective structure is an inlet of the X-ray and the other edge is an outlet of the X-ray, a pitch of the reflective substrates at the outlet side is larger than a pitch at the inlet side. The method includes adjusting the relative positions of the X-ray source and the reflective structure so as to reduce a penumbra amount formed by the X-rays emitted from the passages.

The present invention can efficiently parallelize the generate X-ray with a simple structure. Further, since the X-ray source and the reflective structure are disposed so as to reduce the penumbra amount of an image, so that a resolution of the image is improved.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, a slit lens is used as an X-ray reflective structure (hereinafter, referred to as a reflective structure).

(1) Slit Lens

Figure 1:
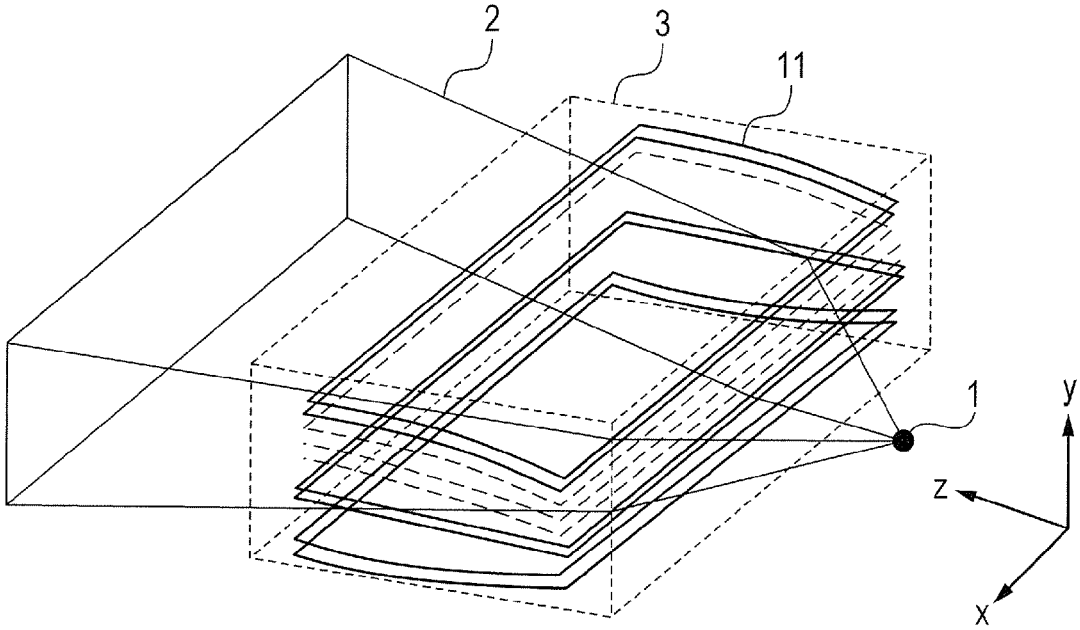
FIG. 1 is a schematic diagram illustrating an X-ray optical apparatus according to an exemplary embodiment of the present invention.

As illustrated in FIG. 1, a slit lens 3 is arranged such that at least three reflective substrates 11 are arranged with an interval therebetween. An interval between adjacent reflective substrates is formed by a spacer. An X-ray 2 which is incident into a plurality of passages whose both sides are put between the reflective substrates 11 is reflected from the reflective substrate 11 at both sides of each of the passages and parallelized to be emitted from each of the passages. When one edge of the slit lens 3 is an inlet of the X-ray and the other edge is an outlet of the X-ray, a pitch of the reflective substrates 11 at the outlet side is larger than a pitch at the inlet side. Here, the pitch refers to a distance between top surfaces or bottom surfaces of the adjacent reflective substrates. The "parallelization" in the present invention means that an X-ray component in a laminated direction (y direction) of the reflective substrate 11 is reduced so that the emission direction of the X-ray becomes parallel (collimates) to a plane (xz plane) perpendicular to the y direction.

(2) Resolving Power

First, in an X-ray imaging apparatus according to the present invention, a penumbra amount (resolution) will be described with reference to FIGS. 1 and 2A, which is generated when an X-ray that is incident into the passage of the slit lens 3 from the X-ray source 1 and emitted from the passage is radiated onto a sample to project a transmission image onto an X-ray detector (hereinafter, referred to as a detector) 4. FIG. 1 is a conceptual diagram of a principle of parallelizing an X-ray in the present invention and FIG. 2A is a cross-sectional view of a YZ plane that passes through the X-ray source 1 of the X-ray optical apparatus illustrated in FIG. 1.

Figure 2A:
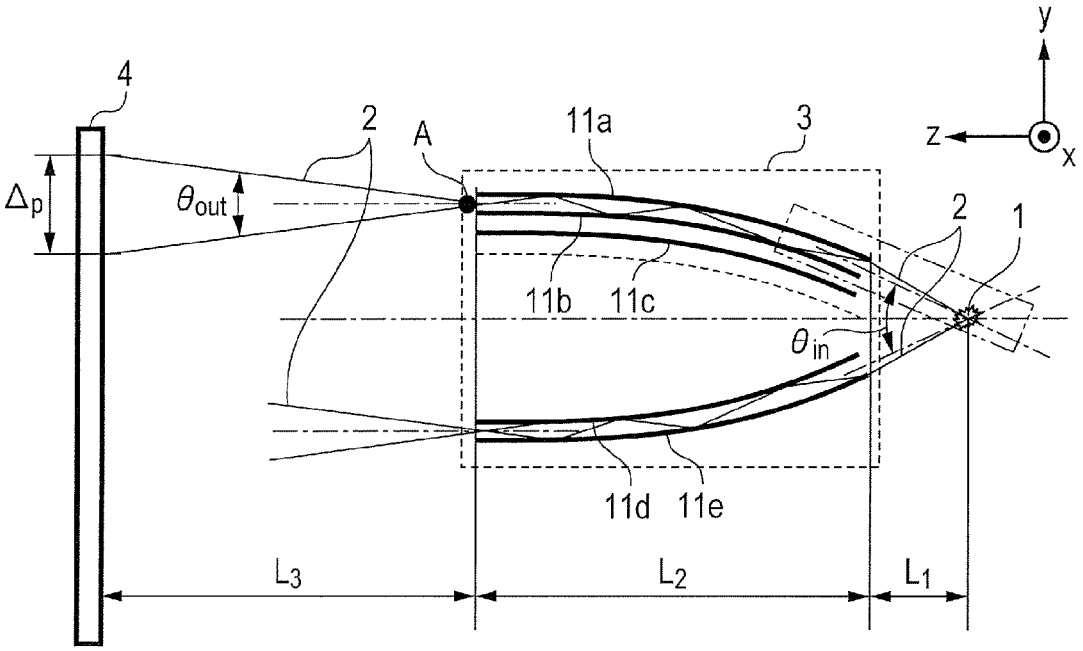
FIG. 2A is a schematic diagram illustrating a reflective structure according to an exemplary embodiment of the present invention.

As illustrated in FIG. 2A, if there is an infinitely small object A at the outlet of the slit lens 3 and a defocused state of an image of the object A is defined as a penumbra amount $\Delta_p$ of the image, the penumbra amount $\Delta_p$ is represented by Equation 1 using a divergence angle $\theta_{out}$ of the X-ray at the outlet of the slit lens 3 and a distance $L_3$ between the outlet of the slit lens 3 and the detector 4 in an opposite direction.

$$\Delta_p = L_3 \times \theta_{out} \quad \text{(Equation 1)}$$

Equation 1 is established with respect to the X-ray which is emitted from each of the passages.

The resolving power of an X-ray imaging apparatus is lowered as the penumbra amount $\Delta_p$ is increased. Therefore, in order to increase the resolving power, if the distance $L_3$ is constant, it is important to lower the divergence angle $\theta_{out}$. In other words, it is important to increase the degree of parallelization of the X-ray which is emitted from each of the passages in the slit lens 3.

The resolving power of the X-ray imaging apparatus is determined by not only the penumbra amount $\Delta_p$ but also by larger one of the penumbra amount $\Delta_p$ and a pixel size $\Delta_d$ of the detector 4 (for example, a flat panel detector (FPD)). If the pixel size $\Delta_d$ is small, the detector 4 becomes expensive and it takes time to perform data transfer processing. In the meantime, if the penumbra amount $\Delta_p$ is lowered, for example, a size of the X-ray source 1 is required to be reduced, so that a load which may be applied to an optical system is increased as described below. Therefore, it is important to keep a balance between the pixel size $\Delta_d$ and the penumbra amount $\Delta_p$. If an acceptable range of a ratio of the pixel size $\Delta_d$ and the penumbra amount $\Delta_p$ is 2, the following Equation 2 is established.

$$0.5 < \Delta_p/\Delta_d < 2 \quad \text{(Equation 2)}$$

(3) Parallelization Principle

Figure 2B:
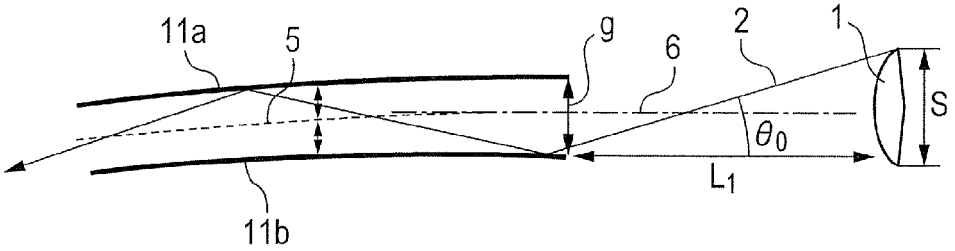
FIG. 2B is an enlarged view of a region enclosed by a two-dot chain line of FIG. 2A.

A principle (parallelization principle) of parallelizing the X-ray, which is emitted from the passages in the slit lens 3, will be described with reference to FIGS. 2A and 2B. FIG. 2B is an enlarged view of a region enclosed by a two-dot chain line of FIG. 2A. Even though a glass plate is used as the reflective substrate 11, the reflective substrate 11 may be metal.

As illustrated in FIG. 2A, the X-ray 2 which is emitted from the X-ray source 1 is divergence light and is radiated in all directions. The slit lens 3 is disposed so as to be separated by a distance $L_1$ from the X-ray source in the opposite direction of the X-ray source 1. The slit lens 3 is arranged such that the glass plates having a gentle curvature are disposed in parallel with predetermined intervals and a pitch of the glass plates at the outlet of the X-ray is larger than a pitch at the inlet of the X-ray. 10 to 1,000 sheets of glass plates each having a thickness of 1 μm to 100 μm are laminated and the X-ray is reflected from both sides of the glass plate. An X-ray 2, which is incident into the passage between the glass plates 11*a* and 11*b*, travels while being reflected from both the glass plates 11*a* and 11*b* and then is emitted from the passage. Similarly in the passage between the glass plates 11*b* and 11*c*, the incident X-ray travels while being reflected from both the glass plates 11*b* and 11*c* and then is emitted from the passage, which is similar in the passage between other adjacent glass plates. Most of the X-rays 2 which are incident into the passages are parallelized as described above. However, among the X-rays 2 which are incident into the passages, an X-ray which travels in a horizontal direction is not reflected from the glass plate but is directly emitted from each of the passages.

As described above, as the X-ray travels in the passage of the slit lens 3, an X-ray whose traveling direction is not a horizontal direction is reflected multiple times from the glass plate so that the traveling direction is gradually close to the horizontal direction. Then, the X-ray is parallelized and emitted from each of the passages. Further, an X-ray which travels in the horizontal direction is directly emitted from each of the passages. Accordingly, it is possible to efficiently parallelize the X-ray to be emitted with a simple structure. By doing this, the penumbra amount $\Delta_p$, which is formed on the detector 4, becomes smaller.

Here, a virtual plane 5 is set in a position which is separated from the glass plates at both sides of the passage with the same distance and a tangential plane 6 of the virtual plane 5 at the inlet of the slit lens 3 is considered. If the X-ray source 1 is disposed on tangential planes of a plurality of virtual planes 5 at the inlet side, more X-rays may be incident into the passages. If all tangential planes 6 of the plurality of virtual planes 5 which are set between the adjacent glass plates at the inlet side intersect on a common straight line and the X-ray source 1 is disposed on the straight line, a size of the X-ray source 1 may be reduced. Further, if the glass plates are parallel to each other at the outlet of the slit lens 3, that is, if the tangential planes 6 of the plurality of virtual planes 5 at the outlet side are approximately parallel to each other, the degree of parallelization of the X-rays emitted from the passages may be increased.

Figure 3:
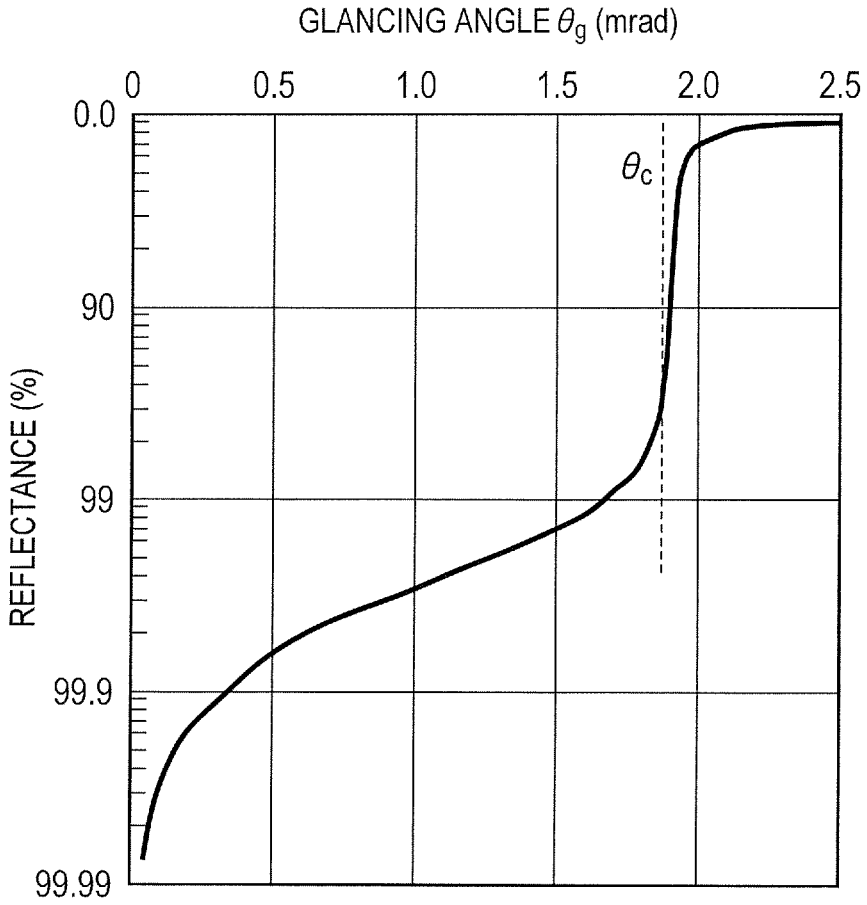
FIG. 3 is a graph illustrating a reflectance of an X-ray of a quartz substrate.

FIG. 3 illustrates an X-ray reflectance of a quartz substrate with respect to an X-ray having a wavelength of 0.071 nm. A horizontal axis is a glancing angle $\theta_g$ at which the X-ray is incident onto each of the passages and a vertical axis is a reflectance of the X-ray. When the glancing angle $\theta_g$ is 0.5 mrad, the reflectance of the X-ray is 99.8% or higher. Therefore, it is understood that 90% or more of the X-rays pass the slit lens even if the X-rays are reflected 50 times. Further, when the glancing angle $\theta_g$ is 1.8 mrad, the reflectance of the X-ray is rapidly attenuated. In this case, the glancing angle $\theta_g$ is referred to as a critical angle and denoted by $\theta_c$. When the X-ray source 1 is disposed on the tangential planes 6 of the plurality of virtual planes 5 at the inlet side, if the angular deviation of the tangential planes 6 is increased, a deviation in an angle at which each of the glass plates brings the X-ray source 1 into view is generated. Then, the X-ray 2 which is emitted from the X-ray source 1 is not reflected on a position where the glancing angle $\theta_g$ is larger than the critical angle $\theta_c$ in the glass plate. Accordingly, when a distance between the X-ray source 1 and the inlet of the slit lens 3 in the opposite direction is $L_1$ and a critical angle of the glancing angle $\theta_g$ at which the X-ray is incident onto the passage is $\theta_c$, the distance $\Delta_s$ between the X-ray source 1 and the passage in a direction perpendicular to the opposite direction needs to satisfy the following Equation 3.

$$\Delta_s < L_1 \times \theta_c \quad \text{(Equation 3)}$$

Therefore, it is required to determine a relative position of the slit lens 3 and the X-ray source 1, that is, a relative position of the glass plate and the X-ray source 1 so as to satisfy Equation 3.

Here, the slit lens 3 will be described, in which the interval between adjacent glass plates is constant and all glass plates are formed such that a thickness at the outlet side is larger than a thickness at the inlet side as illustrated in FIG. 2A. Such a slit lens 3 may be manufactured by laminating glass plates having a wedge shaped thickness. In this case, a maximum glancing angle $\theta_{gmax}$ at which the X-ray is incident onto the passage and is reflected from the glass plate is represented by Equation 4.

$$\theta_{gmax} = (s+g)/2L_1 \quad \text{(Equation 4)}$$

Here, s indicates a size of the X-ray source 1 (diameter of the light source) and is $2\sigma$ when an intensity distribution of the light source is approximated by a Gaussian distribution. g is an interval (gap) between adjacent glass plates. However, $\theta_{gmax}$ needs to be smaller than the critical angle $\theta_c$.

If the glass plates are parallel to each other at the outlet of the slit lens 3, the divergence angle $\theta_{out}$ of the X-ray which is emitted from each of the passages in the slit lens 3 is represented by Equation 5.

$$\theta_{out} = 2 \times \theta_{gmax} \quad \text{(Equation 5)}$$

In this case, the penumbra amount $\Delta_p$ is represented by Equation 6 based on Equations 1, 4, and 5.

$$\Delta_p = L_3 \times (s+g)/L_1 \quad \text{(Equation 6)}$$

Further, Equation 7 is established based on Equations 2 and 6.

$$0.5 \times \Delta_d < L_3 \times (s+g)/L_1 < 2 \times \Delta_d \quad \text{(Equation 7)}$$

If the degree of parallelization of the glass plate is lowered, the X-ray does not reach a pixel of the detector 4 that detects an intensity of the X-ray or a pixel having an extremely weak X-ray intensity is generated. In order to remove such troubles, the parallelism A., of all the glass plates needs to satisfy larger one of an acceptable value $\Delta_{out\text{-}a}$ in the following Equation 8a and an acceptable value $\Delta_{out\text{-}b}$ in the following Equation 8b. Here, $\Delta_d$ indicates a pixel size of the detector 4.

$$\Delta_{out\text{-}a} < (s+g)/L_1 \quad \text{(Equation 8a)}$$

$$\Delta_{out\text{-}b} < \Delta_d/L_3 \quad \text{(Equation 8b)}$$

Figure 4A:
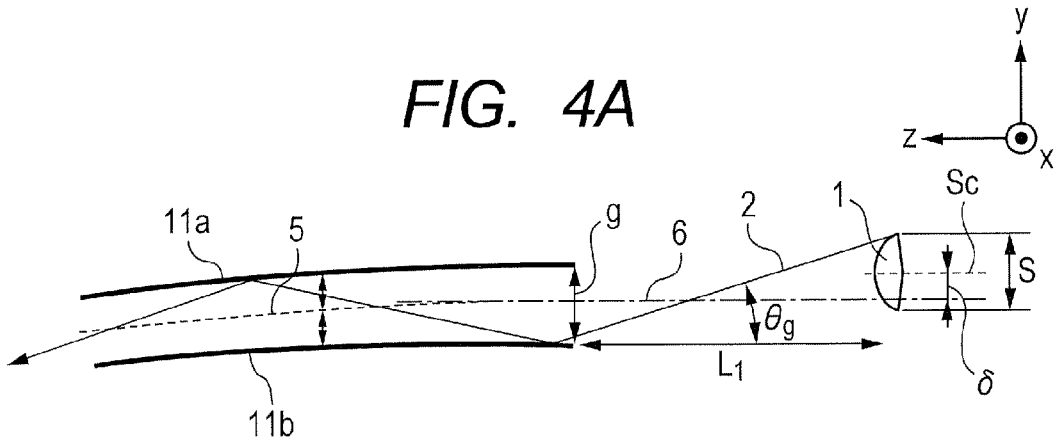
FIG. 4A is a schematic view explaining a relationship of a position of the X-ray source and a penumbra amount.
Figure 4B:
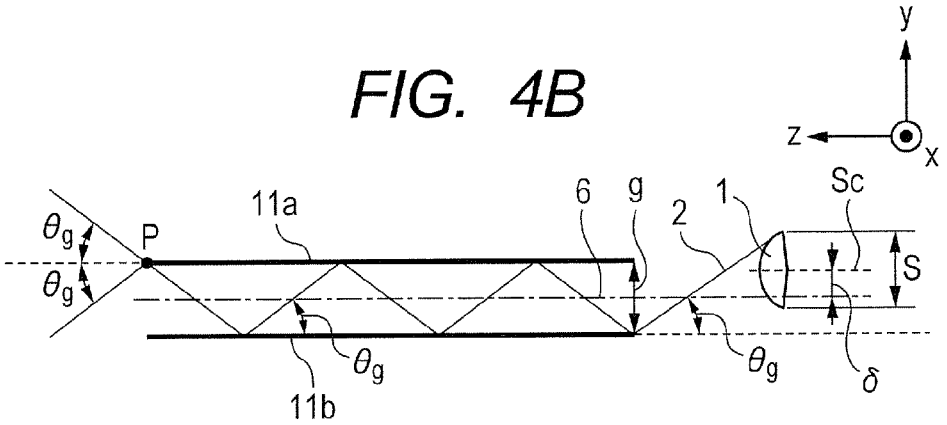
FIG. 4B is a schematic view explaining a relationship of a position of the X-ray source and a penumbra amount.

Here, a size of the penumbra amount $\Delta_p$ which is formed on the detector 4 when the position of the light source is deviated by $\delta$ in a y direction will be described with reference to FIGS. 4A and 4B. In FIG. 4A, when a distance between the light source center position $S_c$ and the tangential plane 6 is deviated by $\delta$ in the y direction, a maximum glancing angle $\theta_{gmax}$ is represented by Equation 9 in accordance with the same manner as the manner by which Equation 4 is derived.

$$\theta_{gmax} = (s/2+g/2+\delta)/L_1 \quad \text{(Equation 9)}$$

Further, a divergence angle $\theta_{out}$ in this case will be described with reference to FIG. 4B. In order to simplify the description, two sheets of parallel plates are considered as the slit lens 3. The X-ray which is incident into the slit lens 3 is repeatedly reflected from the upper and lower glass surfaces while maintaining the glancing angle $\theta_g$ and emitted from the outlet in a +y direction or −y direction with respect to the virtual plane 5. An emission direction is determined based on the number of reflection in the slit lens 3 and the number of reflection is determined based on the glancing angle $\theta_g$ and a length $L_2$ of the slit lens 3 in a z-direction. Further, as illustrated in FIG. 4B, if a final reflection point P matches with an emitting edge of the slit lens 3, the X-ray is reflected from the point P to be emitted in the −y direction. In this case, an X-ray which is incident at an angle which is slightly smaller than the glancing angle $\theta_g$ is emitted in the +y direction without being reflected from the emitting edge of the slit lens 3. Since the glancing angle $\theta_g$ of the X-ray which is incident into the slit lens 3 is continuous in the range of "$0 \le \theta_g \le \theta_{gmax}$", a maximum divergence angle $\theta_{out}$ may be considered to be represented by Equation 5.

The penumbra amount $\Delta_p$ when the light source position is deviated by δ in the y direction is represented by Equation 10 based on Equations 1, 5, and 9.

$$\Delta_p = L_3 \times (s+g+2\delta)/L_1 \quad \text{(Equation 10)}$$

It is understood that if the positional deviation δ of the light source is changed, the penumbra amount $\Delta_p$ is also changed.

Figure 5:
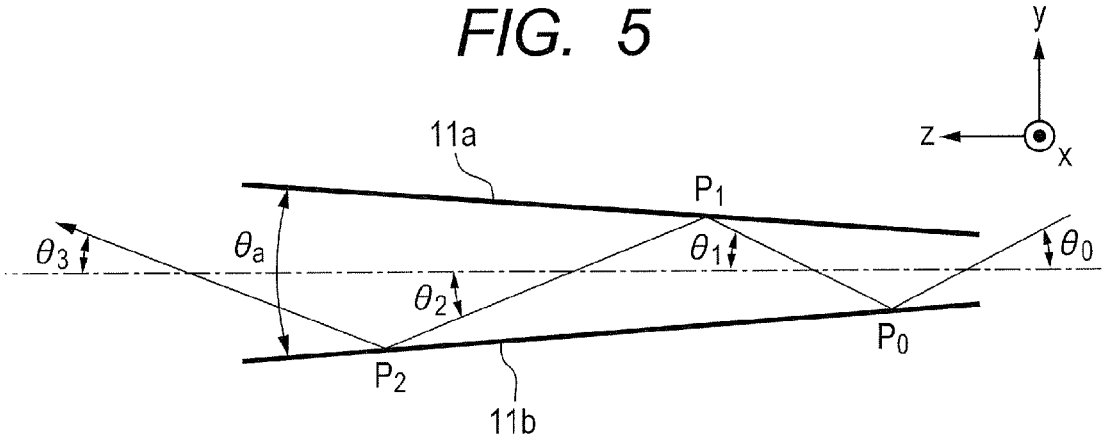
FIG. 5 is a schematic diagram illustrating a reflective structure according to another exemplary embodiment of the present invention.

Next, a slit lens 3 will be described in which thicknesses of all glass plates are constant and an interval between adjacent glass plates at the outlet side is larger than an interval at the inlet side. Here, in order to simplify the description, as illustrated in FIG. 5, a straight guide in which the glass plates 11*a* and 11*b* form an angle $\theta_a$ is considered. If an angle formed by the virtual plane 5 and the X-ray 2 is referred to as a half divergence angle, an X-ray which is incident into the passage between the glass plates 11*a* and 11*b* with the half divergence angle $\theta_0$ ($0.5\times\theta_a<\theta_0<\theta_c$) is reflected at a point $P_0$ of the glass plate 11*b* and then reflected at a point $P_1$ of the glass plate 11*a*. A half divergence angle $\theta_1$ after the first reflection is represented by Equation 11.

$$\theta_1 = \theta_0 - \theta_a \quad \text{(Equation 11)}$$

Therefore, the angle $\theta_n$ after n-th reflection is represented by Equation 12 in a range of "$\theta_0 - n\times\theta_a > 0$".

$$\theta_n = \theta_0 - n\times\theta_a \quad \text{(Equation 12)}$$

If $\theta_n < 0.5\times\theta_a$, the X-ray 2 does not reach the glass plate, so that the half divergence angle is not varied. Further, if an interval (gap) between the adjacent glass plates at the outlet side is $g_{out}$, an interval (gap) between the adjacent glass plates at the inlet side is $g_{in}$ and a length of the glass plate is $L_2$, Equation 13 is established.

$$\theta_a = (g_{out} - g_{in})/L_2 \quad \text{(Equation 13)}$$

In this case, since $\theta_a < \theta_{out}$, the penumbra amount $\Delta_p$ is represented by Equation 14 based on Equations 1 and 13.

$$(g_{out} - g_{in}) \times L_3/L_2 < \Delta_p \quad \text{(Equation 14)}$$

Further, Equation 15 is established based on Equations 2 and 14.

$$0.5\times\Delta_d < L_3 \times (g_{out} - g_{in})/L_2 < 2\times\Delta_d \quad \text{(Equation 15)}$$

For the same reason as the above reason with respect to the slit lens 3 having the structure illustrated in FIG. 2A, even in a slit lens 3 in which thicknesses of all glass plates are constant and an interval between adjacent glass plates at the outlet side is larger than an interval at the inlet side, the glass plates at the outlet of the slit lens 3 may be parallel to each other. Therefore, the parallelism $\Delta_{out}$ of all the glass plates needs to satisfy larger one of an acceptable value $\Delta_{out\text{-}a}$ in the following Equation 16a and an acceptable value $\Delta_{out\text{-}b}$ in the following Equation 16b. Here, $\Delta_d$ indicates a pixel size of the detector 4.

$$\Delta_{out\text{-}a} = (g_{out} - g_{in})/L_2 \quad \text{(Equation 16a)}$$

$$\Delta_{out\text{-}b} < \Delta_d/L_3 \quad \text{(Equation 16b)}$$

In the meantime, a penumbra amount $\Delta_x$ in a dimension where the glass plate does not have a curvature, in other words, a direction (x-direction) perpendicular to both an opposite direction between the X-ray source 1 and the inlet of the slit lens 3 and a direction perpendicular to the opposite direction between the X-ray source 1 and the passage is represented by Equation 17 and determined by the relative positions of the slit lens 3, the X-ray source 1, and the detector 4.

$$\Delta_x = s\times L_3/(L_2+L_1) \quad \text{(Equation 17)}$$

Further, a slit lens 3, where the X-ray source 1 is disposed on the tangential planes of the plurality of virtual planes 5 at the inlet side and the tangential planes of the plurality of virtual planes at the outlet side intersect on a common straight line, may also be applied to the X-ray optical apparatus according to the present invention. The parallelization may be embodied with this structure. If all tangential planes 6 of the plurality of virtual planes 5 at the inlet side intersect on a common straight line and the X-ray source 1 is disposed on the straight line, a size of the X-ray source 1 can be reduced. In this case, the common straight line intersecting at the inlet side is a different line from the common straight line intersecting at the outlet side.

First Exemplary Embodiment

Figure 6:
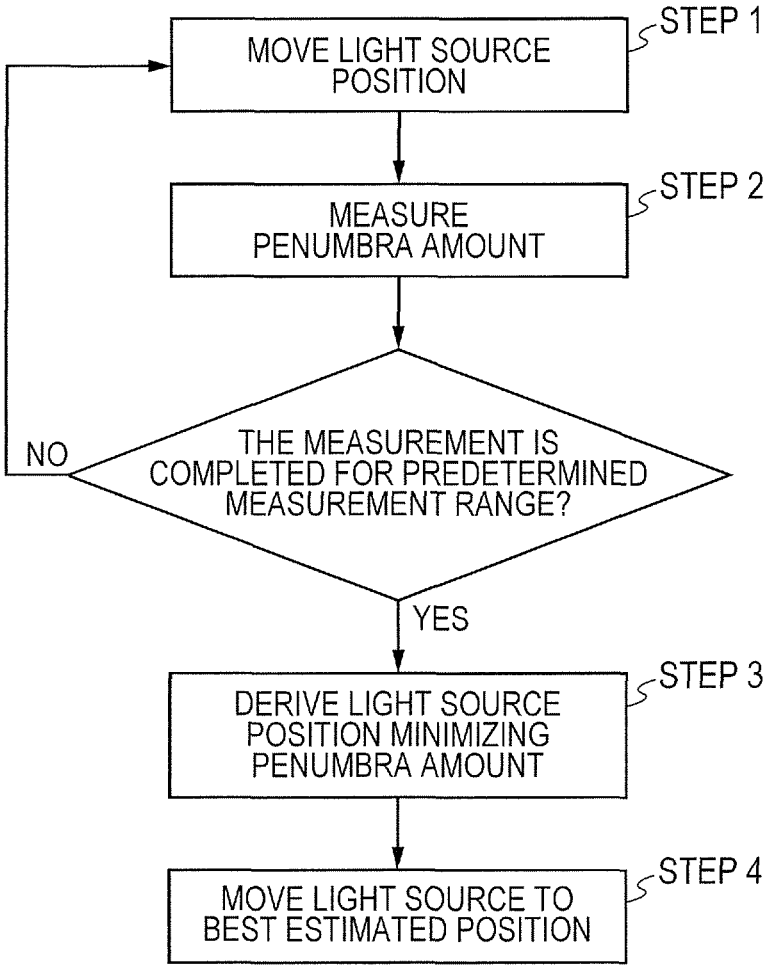
FIG. 6 is a flowchart of an adjusting method of an X-ray optical apparatus according to an exemplary embodiment of the present invention.
Figure 7A:
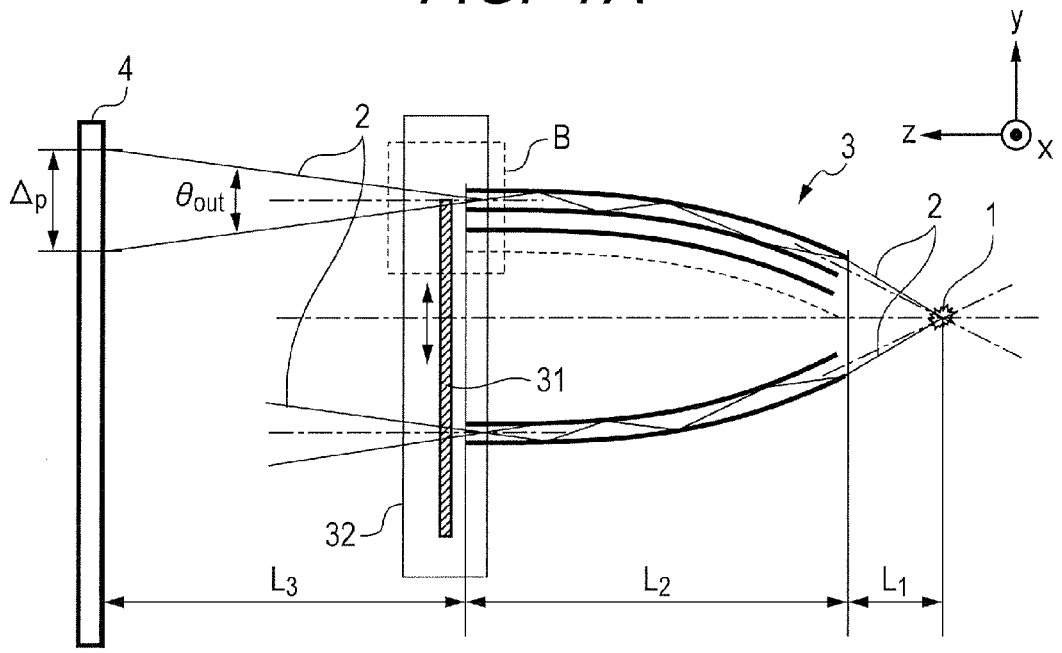
FIG. 7A is a schematic diagram illustrating an X-ray optical apparatus according to a first exemplary embodiment of the present invention.
Figure 7B:
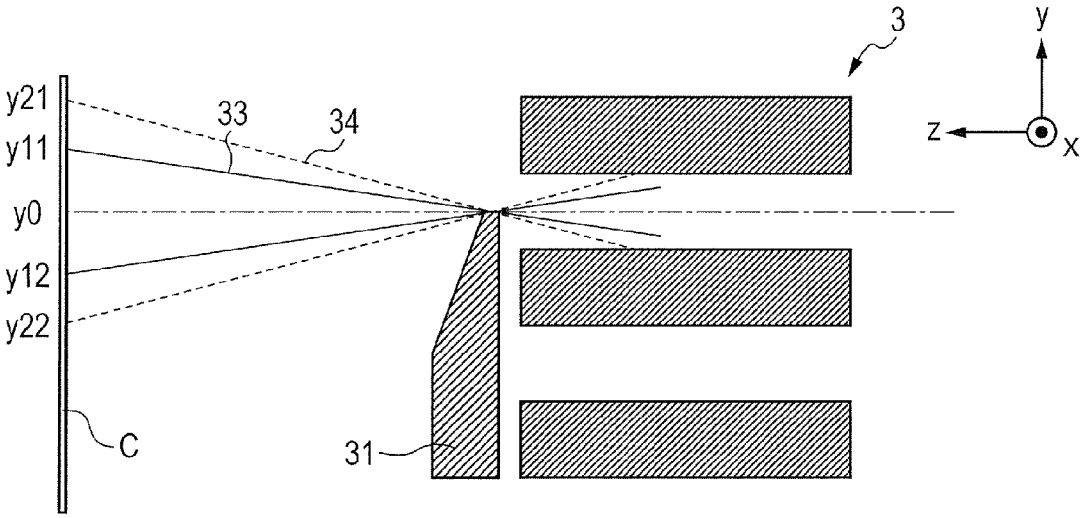
FIG. 7B is a schematic diagram explaining a method of measuring a penumbra amount according to the first exemplary embodiment of the present invention.

A first exemplary embodiment of the present invention will be described in detail with reference to FIGS. 6, 7A, and 7B. FIG. 6 is a flow chart illustrating an adjusting method of an X-ray optical apparatus according to this exemplary embodiment. FIG. 7A illustrates an X-ray optical apparatus according to this exemplary embodiment. FIG. 7B is an enlarged view of a region B around an outlet of a slit lens 3 in FIG. 7A.

In the exemplary embodiment, in order to measure a resolution when an image is projected by an X-ray 2 which passes through the slit lens 3, an object 31 (object for forming penumbra) is disposed between the slit lens 3 and a detector 4 and a penumbra amount formed on the detector 4 by the object 31 is measured. Since the object 31 is used to shield the X-ray, a material of the object 31 may absorb the incident X-ray like gold, platinum, or lead. In a state where the slit lens 3 is fixed, the position of the X-ray source 1 is moved in the y direction (step 1) and a change in the penumbra amount formed on the detector 4 is measured (step 2). A position where the penumbra amount is minimum, that is, a position of the light source (a position of the X-ray source 1) where the resolution becomes highest is derived (step 3) and the light source position is adjusted to the derived position (step 4). As described above, the light source position is adjusted to reduce the penumbra amount to increase the resolution.

In FIG. 7A, the X-ray 2 which is radiated from the X-ray source 1 travels while being reflected from the passage of the slit lens 3, is emitted from the passage, and detected by the detector 4. The object 31 is disposed between the slit lens 3 and the detector 4. The object 31 is arranged to be moved to an arbitrary position at least in the y-axis direction by a moving mechanism 32. The object 31 is moved to the arbitrary position in an optical path when the positions of the X-ray source 1 and the slit lens 3 are adjusted and then removed out of the optical path after completing the position adjustment.

Here, a distance $L_1$ between the X-ray source 1 and the inlet of the slit lens 3 in the opposite direction is 100 mm, a length $L_2$ of the slit lens 3 is 100 mm, and a distance $L_3$ between the outlet of the slit lens 3 and the detector 4 in the opposite direction is 200 mm. A pixel size $\Delta_d$ of the detector 4 is 100 μm and a size s of the X-ray source 1 is 100 μm. An interval (gap) g between adjacent glass plates is constantly 10 μm and a thickness of all glass plates is 40 μm at the outlet side and 10 μm at the inlet side.

Figure 8:
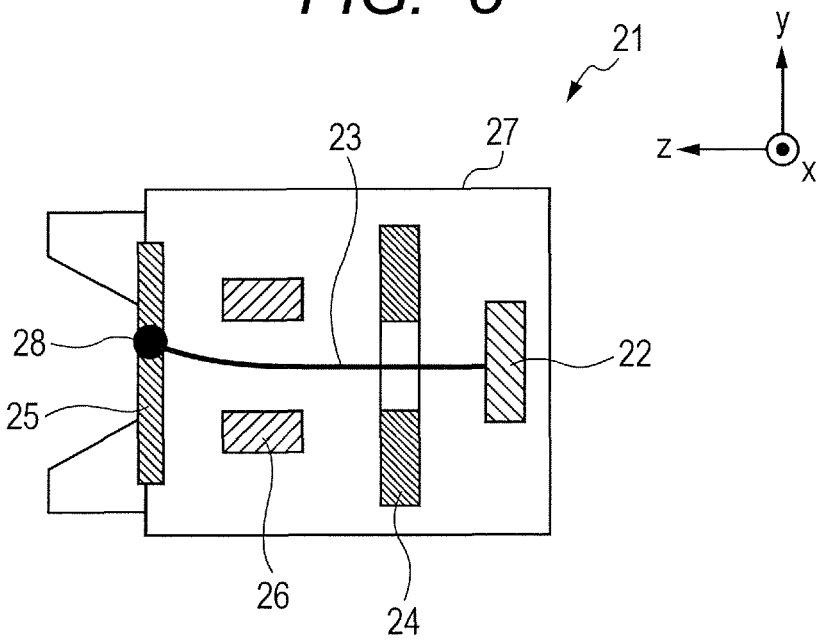
FIG. 8 is a schematic diagram illustrating a light source position moving mechanism according to the first exemplary embodiment of the present invention.

A scanning method of the X-ray source 1 in the y direction will be described. The X-ray source 1 may be moved by using a mechanical moving mechanism or by electrical manipulation described below. A light source position moving mechanism 21 used in the exemplary embodiment, as illustrated in FIG. 8, includes an electron beam source 22, an electron lens 24 (lens electrode) that converges an electron beam 23, a deflector 26 that deflects the electron beam 23, and a transmissive target (hereinafter, referred to as a target) 25 for generating an X-ray, which are disposed in a vacuum container 27. An electron which is extracted from the electron beam source 22 is converged by the electron lens 24 and incident into the target 25. When the electron beam 23 is incident into the target 25, an X-ray is radiated from a surface opposite to a surface of the target into which the electron beam 23 is incident. Therefore, a position where the electron beam 23 is incident into the target 25 becomes a light source position 28. In this case, the electron beam 23 is deflected in the y direction by the deflector 26 so that the position of the electron beam 23 which is incident into the target 25 is moved in the y direction and the light source position 28 is moved in the y direction. By using such an X-ray source 1 described above, the light source position 28 may be moved by performing an electrical manipulation on the deflector 26.

Here, a principle for measuring the penumbra amount in the exemplary embodiment will be described.

As illustrated in FIG. 7B, the object 31 is disposed such that an edge thereof is located on the optical path in the slit. An X-ray which is radiated from an X-ray source 1 (not illustrated) passes through the slit lens 3 and a part of the X-ray passing the slit lens 3 is shielded by the object 31, so that a penumbra of the object 31 appears on a plane C which is disposed at a downstream of the slit lens 3. A solid line 33 indicates a state of the X-ray when the relative positions of the X-ray source 1 and the slit lens 3 are fitted to each other and a broken line 34 indicates a state of the X-ray when the relative positions of the X-ray source 1 and the slit lens 3 are deviate.

Figure 9:
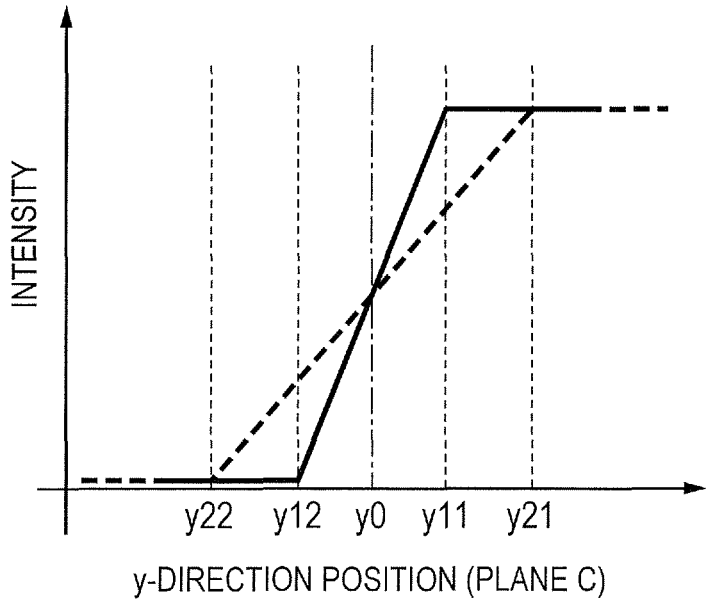
FIG. 9 is a graph illustrating a distribution of an intensity of an X-ray.

A distribution of X-ray intensity in the y-direction on the plane C when the intensity of the X-ray source 1 does not have deviation or is uniform will be described with reference to FIG. 9. A y-direction position on the plane C is represented at a horizontal axis and the intensity of the X-ray is represented at a vertical axis. When the relative positions of the X-ray source 1 and the slit lens 3 are fitted to each other, in a region below a position y12, all X-rays that pass through the slit lens 3 are shielded by the object 31, so that the intensity is 0. In a region above a position y11, the X-ray reaches the detector 4 without being shielded by the object 31. A region between y11 and y12 indicates a defocused state caused when the X-ray source 1 has a size, that is, a penumbra amount and a size of the region is represented by "y11-y12". If a penumbra amount when the light source position is deviated in the y direction is considered, the positional deviation of the X-ray source 1 increases the divergence angle $\theta_{out}$ in accordance with Equations 4 and 5. Therefore, in the intensity distribution on the detector, as indicated by the broken line, the intensity becomes 0 below the position y22 and the X-ray reaches the detector 4 without being shielded above the position y21. At this time, the penumbra amount is y21-y22.

Further, in the X-ray optical apparatus according to the exemplary embodiment illustrated in FIG. 7A, a penumbra amount $\Delta_p$ on the detector when the light source position is deviated by $\delta$ in the y direction is represented by Equation 10 above.

Figure 10:
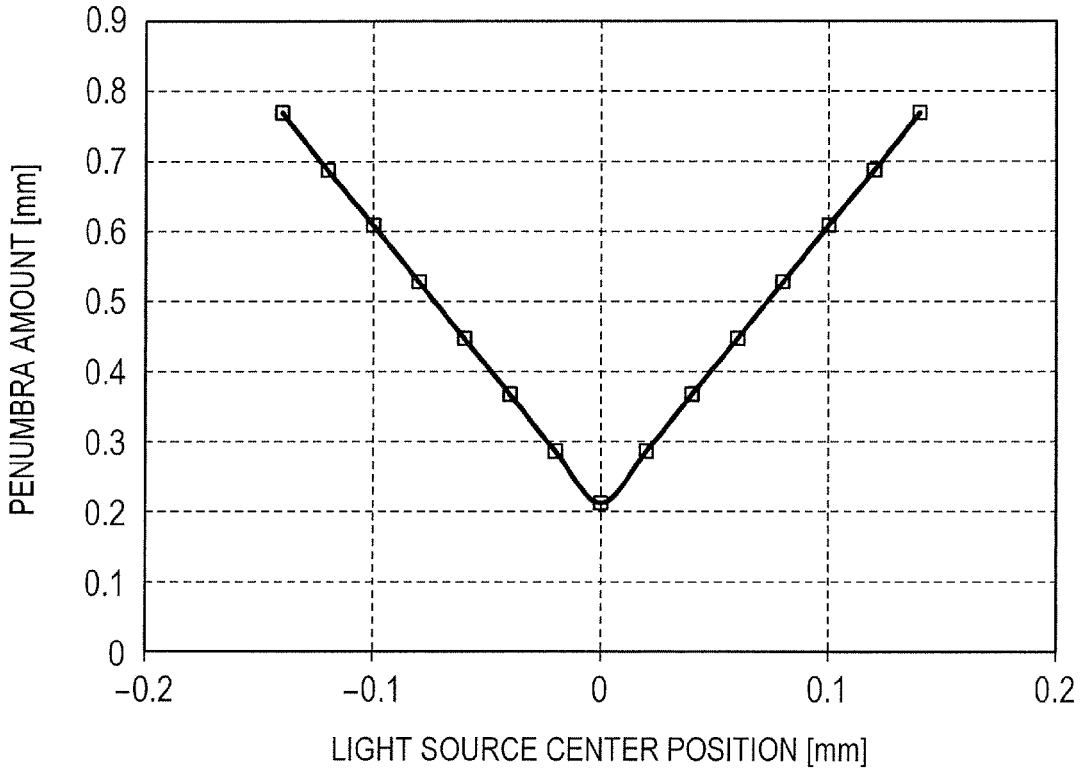
FIG. 10 is a graph illustrating a relationship of a light source center position and a penumbra amount.

Based on the structure of the apparatus and the principle for the measurement of the penumbra amount described above, when the light source position is moved in the y direction while fixing the slit lens 3, the penumbra amount $\Delta_p$ is changed as illustrated in a graph in FIG. 10. In FIG. 10, the light source center position is a light source position (a position of the X-ray source 1) and the penumbra amount is a function of the light source center position when the position of the slit lens 3 is fixed. The y direction position of the X-ray source 1 is represented at the horizontal axis and the penumbra amount is represented at the vertical axis. From the graph of the change in the penumbra amount obtained by scanning measurement of the light source position, a light source position where the penumbra amount is minimum is derived (determined) as the light source center position where the light source is to be disposed. Thereafter, the X-ray source 1 is moved to the derived light source center position.

With the structure according to the exemplary embodiment, the penumbra amount of the X-ray on an X-ray detector is measured while changing the relative positions of the X-ray source 1 and the slit lens 3. Further, the X-ray source is adjusted to the position where the penumbra amount is minimum, so that the X-ray source can be adjusted in a positional relationship where the highest resolution is obtained.

In FIG. 7B, even though the penumbra amount is measured at an outside passage, the penumbra amount may be measured at other passage than the outside passage.

In the exemplary embodiment, even though the light source position 28 is changed by deflecting the electron beam 23 in the X-ray source, the X-ray source (a main body of the light source) or the slit lens 3 may be moved.

As the number of reflection on the glass plate is increased, an influence by an angle at the inlet side of the slit lens 3 is increased. Therefore, rather than the slit lens 3 in which the thicknesses of all the glass plates are constant and an interval between adjacent glass plates at the outlet side is larger than the interval at the inlet side, a slit lens 3 in which intervals between adjacent glass plates are constant and a thickness of all glass plates at the outlet side is larger than the thickness at the inlet side is preferable.

Second Exemplary Embodiment

Figure 11A:
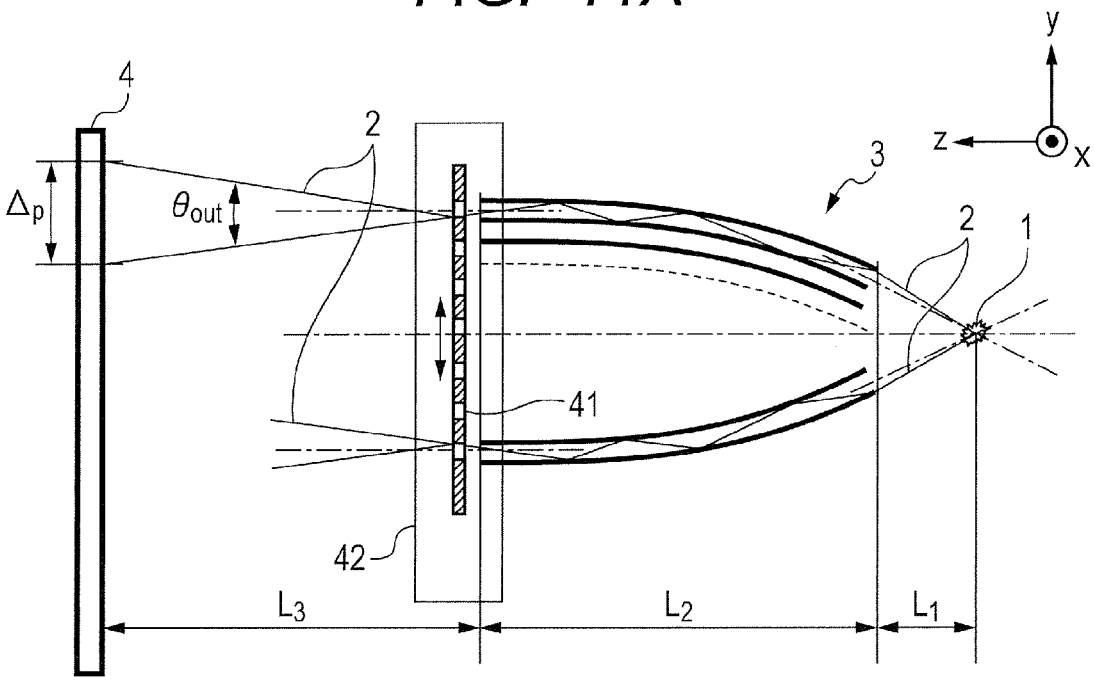
FIG. 11A is a schematic diagram illustrating an X-ray optical apparatus according to a second exemplary embodiment of the present invention.
Figure 11B:
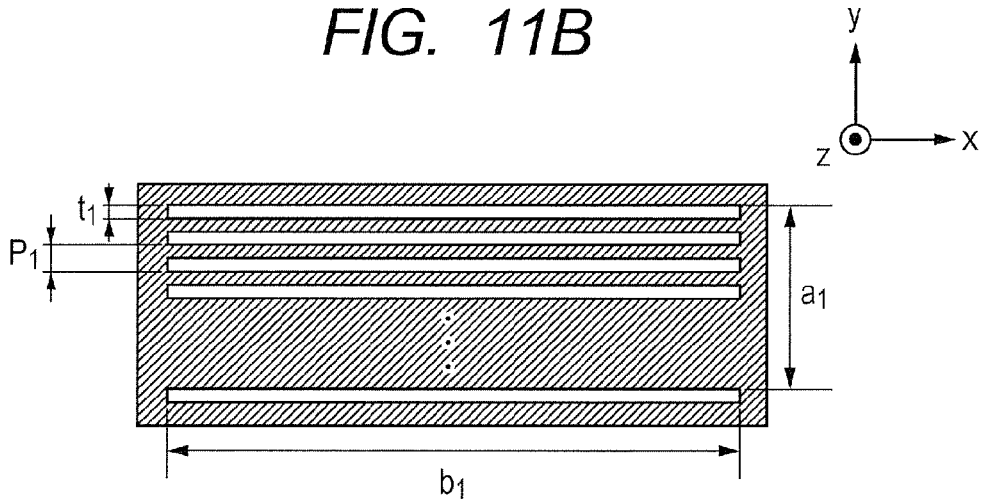
FIG. 11B is a schematic diagram illustrating a one-dimensional grating according to the second exemplary embodiment of the present invention.

A second exemplary embodiment of the present invention will be described with reference to FIGS. 11A and 11B. Here, only difference from the first exemplary embodiment will be described. In the exemplary embodiment, as illustrated in FIG. 11A, a one-dimensional grating 41 (hereinafter, referred to as a "slit array 41") for forming a penumbra is provided. The slit array 41 is arranged to be moved to an arbitrary position at least in the y-axis direction by a moving mechanism 42. In the exemplary embodiment, the slit array 41 is disposed between a slit lens 3 and a detector 4 and a penumbra amount which is formed on the detector 4 by the slit array 41 is measured. The slit array 41 in the exemplary embodiment is illustrated in FIG. 11B. The slit array 41 is an element in which 30 slits each having an aperture width $t_1$ of 20 μm and a length $b_1$ of 300 mm are arranged in a plate shaped member which can shield the X-ray such as gold, platinum, or lead in the y direction with a pitch $P_1$ of 650 μm. A length $a_1$ of the y direction thereof is 19.5 mm. As illustrated in FIG. 11A, the slit array 41 is disposed at the downstream of the slit lens 3 so that the penumbra amount of each passage in the slit lens 3 may be measured. Actually, since the passages in the slit lens have different parallelism caused by a manufacturing error, the penumbra amount thereof may be slightly varied. By considering an average of the penumbra amount for every passage, the light source position is adjusted to minimize the penumbra amount of entire slit lenses.

Figure 12:
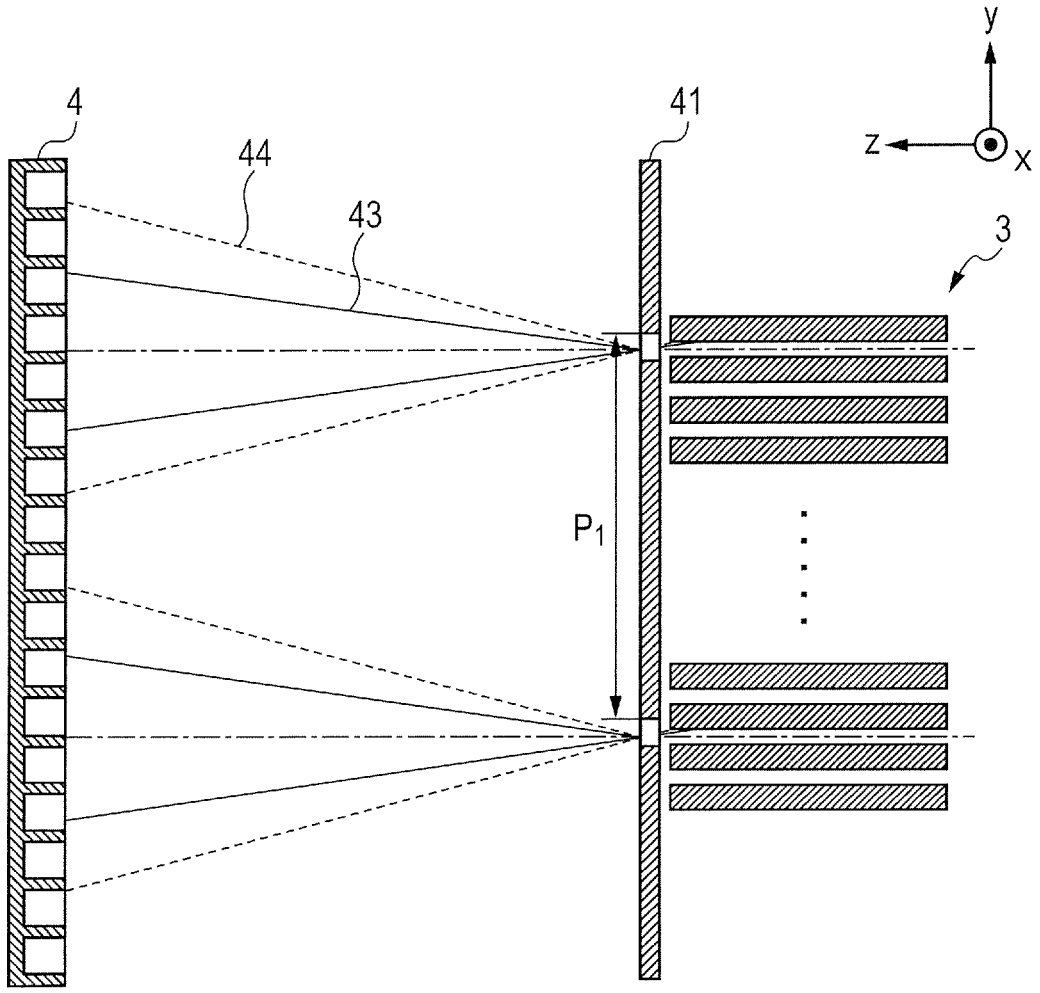
FIG. 12 is a schematic diagram explaining a size of a pitch of the one-dimensional grating.

A size of the pitch $P_1$ in the slit array 41 will be described with reference to FIG. 12. The pitch $P_1$ is set to be 650 μm in order to avoid the X-rays which pass through the another passage in the slit lens from being superimposed each other on the detector when the deviation of the relative positions of the X-ray source 1 and the slit lens 3 is in a predetermined range. If the deviation of the relative positions of the X-ray source 1 and the slit lens 3 in the y direction is 0, the penumbra amount $\Delta_p$ is 220 μm in accordance with Equation 10 and the state of the X-ray at that time is represented by the solid line 43. Further, if the deviation of the relative positions of the X-ray source 1 and the slit lens 3 in the y direction is 100 μm (δ=100 μm), the penumbra amount $\Delta_p$ is 620 μm in accordance with Equation 10 and the state of the X-ray at that time is represented by the broken line 44. Here, since the pitch P1 of the slit array 41 is 650 μm, if the deviation of the relative positions of the X-ray source 1 and the slit lens 3 is within 100 μm, as illustrated in FIG. 12, the superimposition on the detector of the X-rays which pass through the another passage in the slit lens may be avoided.

With the structure according to the exemplary embodiment, the penumbra amount of the X-ray on an X-ray detector is measured while changing the relative positions of the X-ray source 1 and the slit lens 3. Further, the X-ray source is adjusted to the position where the penumbra amount is minimum, so that the X-ray source is adjusted in a positional relationship where the highest resolution is obtained.

Further, in the exemplary embodiment, the penumbra amounts of 30 passages may be independently and collectively measured. By calculating an average value of the penumbra amounts of the 30 passages, the influence by an error of each of the passages is smaller than that of the measurement at a single passage. Therefore, the relative positions of the X-ray source 1 and the slit lens 3 can be adjusted with a higher precision.

Third Exemplary Embodiment

Figure 13A:
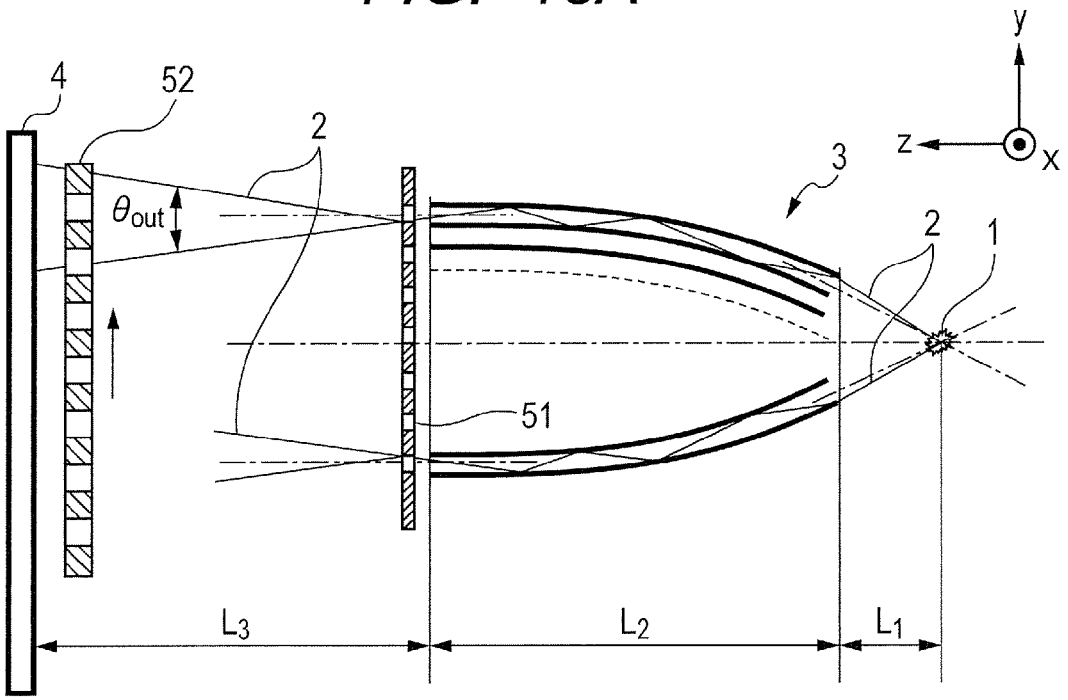
FIG. 13A is a schematic diagram illustrating an X-ray optical apparatus according to a third exemplary embodiment of the present invention.
Figure 13B:
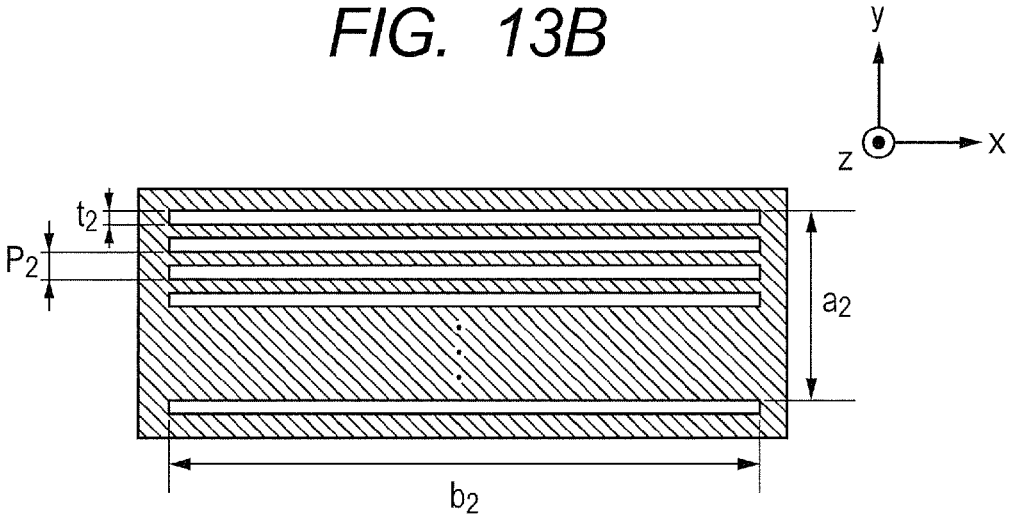
FIG. 13B is a schematic diagram illustrating a one-dimensional grating according to the third exemplary embodiment of the present invention.

A third exemplary embodiment of the present invention will be described with reference to FIGS. 13A and 13B. Here, only difference from the first and second exemplary embodiments will be described. In the exemplary embodiment, a first one-dimensional grating 51 (hereinafter, referred to as a "slit array 51") for forming a penumbra is provided. Further, as illustrated in FIG. 13A, a second one-dimensional grating 52 (hereinafter, referred to as a "slit array 52") for generating a moiré stripe is provided between the slit array 51 and a detector 4. The slit arrays 51 and 52 are arranged to be moved to an arbitrary position at least in the y-axis direction by a moving mechanism which is not illustrated. In the exemplary embodiment, the slit array 51 and the slit array 52 are disposed between a slit lens 3 and the detector 4 in order from an outlet side of the slit lens 3 and an interval of the moiré stripes of the X-ray formed by the two slit arrays is measured to estimate a penumbra amount from a measurement value. The slit array 52 in the exemplary embodiment is illustrated in FIG. 13B. The penumbra amount is detected by using an interval of the moiré stripes (stripe cycle) of the X-ray formed by the slit array 52 having an arbitrary pitch. The slit array 52 is an element in which 50 slits each having an aperture width $t_2$ of 200 μm and a length $b_2$ of 600 mm are arranged in a plate shaped member which can shield the X-ray such as gold, platinum, or lead in the y direction with a pitch $P_2$ of 400 μm. A length $a_2$ of the y direction thereof is 20 mm.

The X-ray which passes the slit lens 3 and is taken out in a cycle by the slit array 51 has an intensity distribution having the same cycle as the cycle of the slit array 51 in the y direction.

The X-ray is incident onto the slit array 52 for generating the moiré stripe, so that the moiré stripe is measured on the detector 4. The stripe cycle P of the generated moiré stripes is represented by the following relational expression (Equation 18) using a cycle $P_a$ of the intensity distribution of the X-ray which is taken out by the slit array 51 and a period $P_b$ of the slit array 52 for generating the moiré stripe.

$$1/P=|1/P_a-1/P_b| \quad \text{(Equation 18)}$$

In other words, the stripe cycle P of the generated moiré stripe is extended by "$P_b/|1/P_a-1/P_b|$" times of the period $P_a$.

The cycle of the intensity distribution in the y direction of the X-ray which is taken out by the slit array 51 is enlarged and the X-ray is incident onto the detector 4, so that the cycle of the intensity distribution of the X-ray may be increased with respect to the pixel size $\Delta_d$ of the detector 4 and the detection resolution of the intensity distribution in the y direction may be improved. Therefore, the penumbra amount can be measured with a higher precision and the light source position can be adjust with a higher precision.

A method of determining the pitch $P_b$ of the slit array 52 for generating a moiré stripe will be described. In the exemplary embodiment, the cycle of the slit array 51 is 650 μm, so that the $P_a$ is 650 μm. If the period P of the intensity distribution to be measured on the detector, for example, is set to 1,300 μm which is twice of $P_a$, $P_b$ is 433 μm from Equation 18.

With the structure according to the exemplary embodiment, the penumbra amount of the X-ray with an extended cycle on an X-ray detector is measured while changing the relative positions of the X-ray source 1 and the slit lens 3. Further, the X-ray source is adjusted to the position where the penumbra amount is minimum, so that the X-ray source can be adjusted in a positional relationship where the highest resolution is obtained.

Fourth Exemplary Embodiment

Figure 14A:
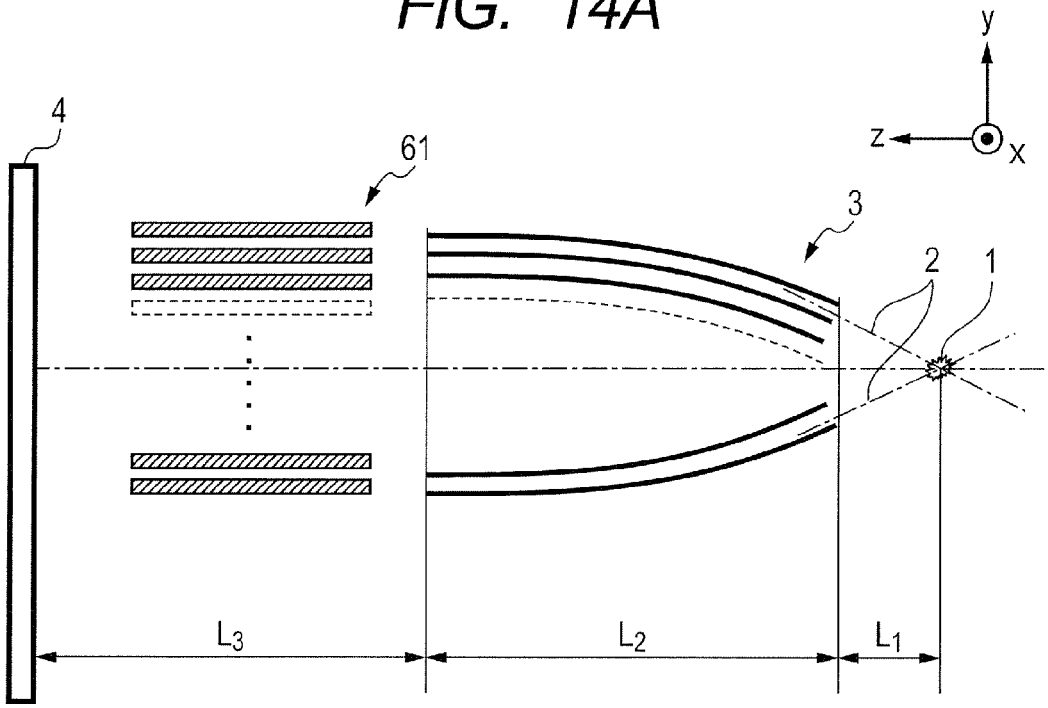
FIG. 14A is a schematic diagram illustrating an X-ray optical apparatus according to a fourth exemplary embodiment of the present invention.

A fourth exemplary embodiment of the present invention will be described with reference to FIGS. 14A and 14B. Here, only difference from the first to third exemplary embodiments will be described. In the exemplary embodiment, as illustrated in FIG. 14A, a solar slit 61 is disposed between a sit lens 3 and a detector 4, an intensity of an X-ray which passes through the solar slit is measured, and a penumbra amount is estimated from a measurement value.

The solar slit 61 is an element in which a plurality of flat shielding plates is disposed with a regular interval so as to be parallel to each other. An X-ray which has a divergence angle having a predetermined angle or larger is shielded by a side wall of the shielding plate and an X-ray which has a divergence angle having a predetermined angle or less passes through the solar slit 61 without being shielded. In other words, an intensity of the X-ray that passes through the solar slit 61 is measured to calculate a divergence angle of the X-ray which is incident into the solar slit 61, so that the penumbra amount may be estimated by using the divergence angle.

A range of the divergence angle of the X-ray which is shielded by the solar slit 61 is determined by an aperture angle of the solar slit 61. Here, the aperture angle ϕ is represented by the following Equation 19 using a length $L_s$ of the solar slit shielding plate in an X-ray traveling direction and an interval $t_s$ between the shielding plates.

$$\phi=2\times\arctan(t_s/L_s) \quad \text{(Equation 19)}$$

If the aperture angle ϕ is larger than the divergence angle θ, the X-ray which is incident into the solar slit 61 with the divergence angle θ may pass through the solar slit without being shielded by the solar slit shielding plate. In other words, the aperture angle ϕ may be set to be equal to or lower than a divergence angle θ to be detected.

Here, if a divergence angle when there is no positional deviation of the X-ray source 1 and the slit lens 3, that is, when the divergence angle of the X-ray which is radiated from the slit lens 3 is minimum is $\theta_{min}$, an aperture angle $\phi$ of the solar slit may be represented by Equation 20.

$$\phi \leq \theta_{min} \quad \text{(Equation 20)}$$

In this case, in accordance with Equation 19, when the length $L_s$ of the solar slit shielding plate is constant, the interval $t_s$ of the shielding plates is reduced as $\phi$ is reduced, so that the intensity of detected X-ray is also reduced. In order to remove such a trouble, in the exemplary embodiment, the interval $t_s$ of the shielding plates is determined based on a condition where "$\phi=\theta_{min}$".

Figure 14B:
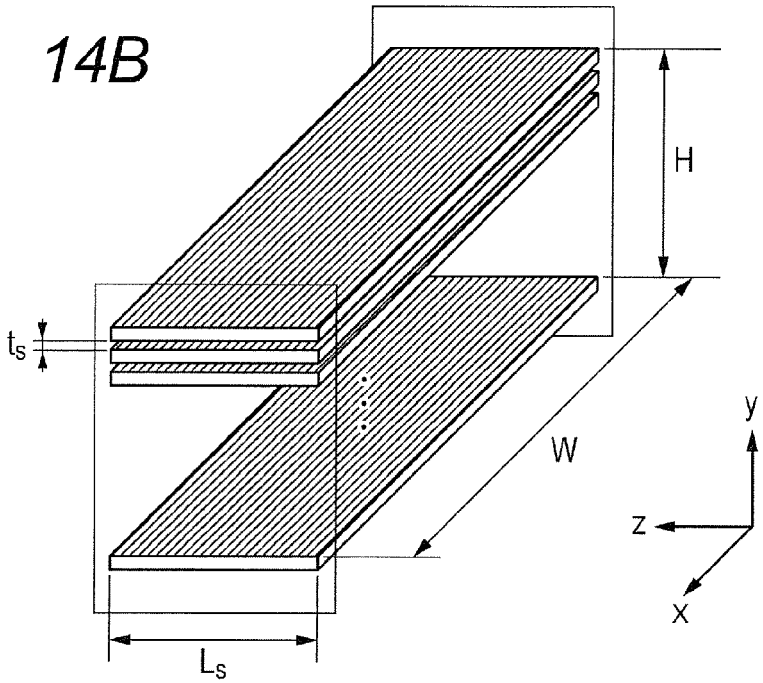
FIG. 14B is a schematic diagram illustrating a solar slit according to the fourth exemplary embodiment of the present invention.

A solar slit 61 used in the exemplary embodiment is illustrated in FIG. 14B. A length $L_s$ of the solar slit is 100 mm, a width W is 300 mm, and a height H is 100 mm. Further, $\theta_{min}$ is 1.1 mrad. In this case, the interval $t_s$ of the shielding plates is 55 μm based on the condition where "$\phi=\theta_{min}$".

With the structure according to the exemplary embodiment, the intensity of the X-ray that passes through the solar slit 61 is measured while relatively changing the positions of the X-ray source 1 and the solar slit 3. Since a divergence angle with which the X-ray is incident into the solar slit 61 is calculated from the measured X-ray intensity, the X-ray source is adjusted to a position where the penumbra amount estimated from the divergence angle is minimum, so that the X-ray source may be adjusted in a positional relationship where the highest resolution is obtained.

Fifth Exemplary Embodiment

Figure 15A:
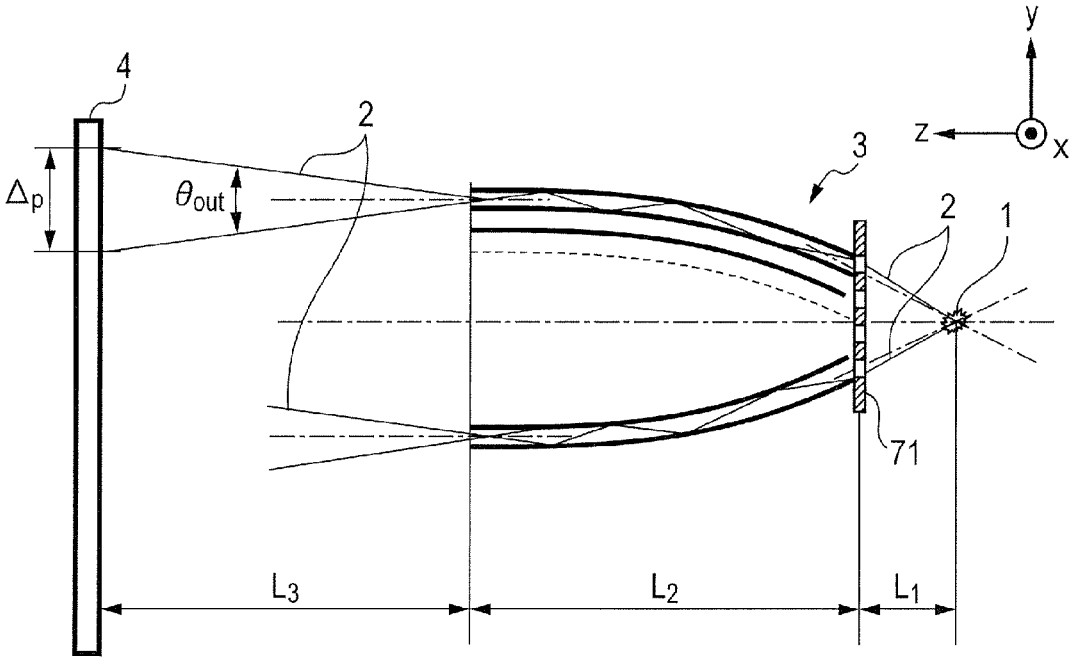
FIG. 15A is a schematic diagram illustrating an X-ray optical apparatus according to a fifth exemplary embodiment of the present invention.

A fifth exemplary embodiment of the present invention will be described with reference to FIGS. 15A and 15B. Here, only difference from the first to fourth exemplary embodiments will be described. In the exemplary embodiment, in order to measure a penumbra amount of an optical system including an X-ray source 1 and a slit lens 3, as illustrated in FIG. 15A, a one-dimensional grating 71 (hereinafter, referred to as a "slit array 71") for selecting a passage is disposed between the X-ray source 1 and the slit lens 3. The slit array 71 is an element for introducing an X-ray from the X-ray source 1 into only a specific passage at an inlet of the slit lens 3 so that an X-ray from the X-ray source is not incident into other passage than the selected passage. The X-ray which passes through the selected passage is emitted from the slit lens 3 with the divergence angle represented by Equation 5 and a range in a y direction where the X-ray is irradiated on the detector is as represented by Equation 10.

In the second exemplary embodiment, a method that disposes the slit array for forming the penumbra at the downstream of the slit lens 3 to measure a penumbra amount formed by shielding the X-ray by the slit array is described. In the present exemplary embodiment, the slit array 71 is disposed at an upstream of the slit lens 3 so as to restrict the passage of the slit lens 3 into which the X-ray is incident from the X-ray source 1, measure the size of the X-ray emitted from a specific passage, and estimate a penumbra amount from a measurement value.

Figure 15B:
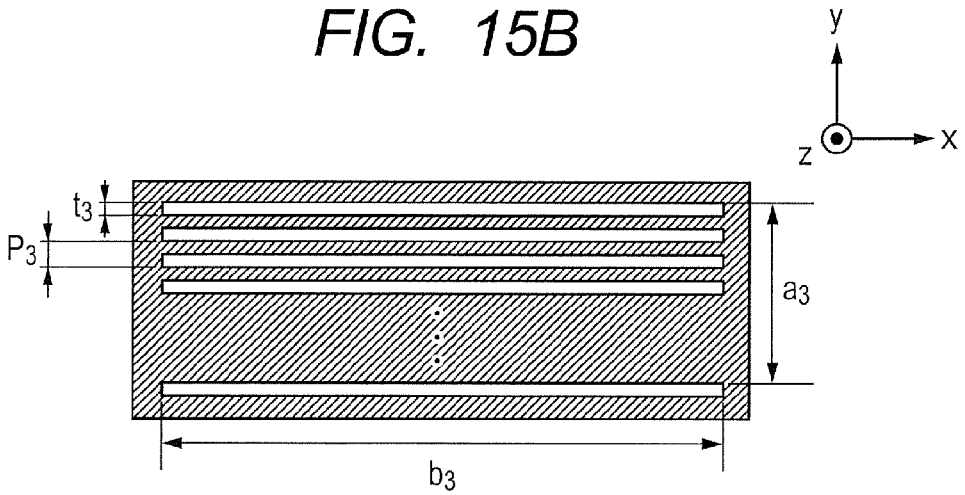
FIG. 15B is a schematic diagram illustrating a one-dimensional grating according to the fifth exemplary embodiment of the present invention.
Figure 16:
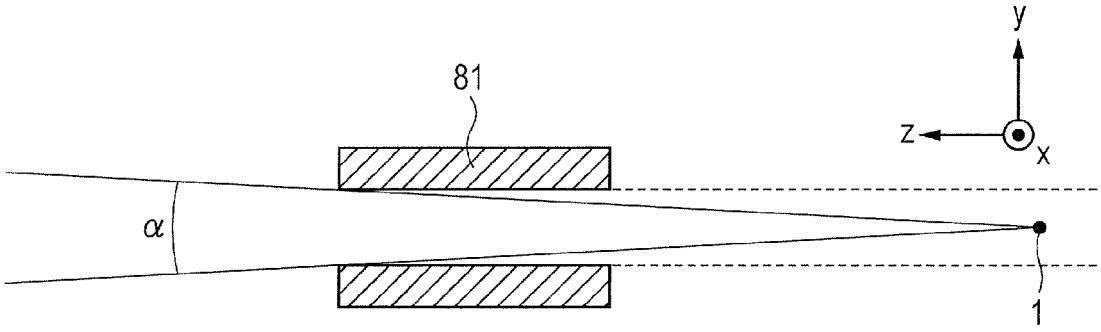
FIG. 16 is a view illustrating an optical element according to a related art.

The slit array 71 used in the exemplary embodiment is illustrated in FIG. 15B. The slit array 71 is an element in which 30 slits each having an aperture width $t_3$ of 20 μm and a length $b_3$ of 300 mm are arranged in a plate shaped member which can shield the X-ray such as gold, platinum, or lead in the y direction with a pitch $P_3$ of 260 μm. A length $a_3$ of the y direction thereof is 7.8 mm. The above-mentioned element is provided near the inlet of the slit lens 3. In this case, the slit array 71 is disposed so as not to block an opening of a selected specific passage. As described above, the slit array 71 and the slit lens 3 are disposed so as to fit the positions thoseof, so that the passages of the slit lens 3 may be restricted to be total 30 for every thirteen.

If there is no deviation in the relative position of the X-ray source 1 and the slit lens 3, an X-ray which passes through one of the passages is detected with a size of 220 μm on the detector (irradiation range in the y direction) in accordance with Equation 10. Further, the relational position of the X-ray source 1 and the slit lens is deviated by 100 μm, the X-ray is detected on the detector to have a size of 620 μm.

With this structure according to the exemplary embodiment, the size of X-ray on the detector is measured while relatively changing the position of the X-ray source 1 and the slit lens 3. Since the penumbra amount is minimized when the measured size of the X-ray is minimum, the X-ray source is adjusted to a position where the size of the X-ray is minimized, so that the X-ray source may be adjusted in a positional relationship where the highest resolution is obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-056843, filed on Mar. 14, 2012, which is hereby incorporated by reference herein in its entirety.

What is claimed is:

1. A method of adjusting an X-ray optical apparatus, said X-ray optical apparatus including:

an X-ray source; and a reflective structure in which at least three reflective substrates are arranged with an interval, and X-rays which are incident into a plurality of passages, both sides of each passage being put between the reflective substrates, are reflected and parallelized by the reflective substrate at both sides of each passage to be emitted from the passage, wherein when one edge of the reflective structure is an inlet of the X-ray and the other edge is an outlet of the X-ray, a pitch of the reflective substrates at the outlet side is larger than a pitch at the inlet side, the method comprising adjusting the relative positions of the X-ray source and the reflective structure so as to reduce a penumbra amount formed by the X-ray emitted from each passage.

2. The method of adjusting an X-ray optical apparatus according to claim 1, wherein the penumbra amount is a penumbra amount formed by an object when the X-ray emitted from the passage is irradiated onto the object.

3. The method of adjusting an X-ray optical apparatus according to claim 1, wherein the penumbra amount is a penumbra amount formed by a one-dimensional grating when the X-ray emitted from the passage is irradiated onto the one-dimensional grating.

4. The method of adjusting an X-ray optical apparatus according to claim 1, wherein when the X-ray emitted from the passage is irradiated onto a first one-dimensional grating and a second one-dimensional grating which are disposed in order from the outlet side of the reflective structure, the penumbra amount is estimated based on an interval of moiré stripes of the X-ray formed by the two one-dimensional gratings.

5. The method of adjusting an X-ray optical apparatus according to claim 1, wherein when the X-ray emitted from the passage is irradiated onto a solar slit, the penumbra amount is estimated based on an intensity of the X-ray which passes through the solar slit.

6. The method of adjusting an X-ray optical apparatus according to claim 1, wherein in a state where a one-dimensional grating that allows the X-ray to be incident into only a specific passage is disposed between the X-ray source and the reflective structure, the penumbra amount is estimated based on a size of the X-ray emitted from the specific passage.

7. An X-ray optical apparatus, comprising:

an X-ray source; and a reflective structure in which at least three reflective substrates are arranged with an interval, and X-rays which are incident into a plurality of passages, both sides of each passage being put between the reflective substrates, are reflected and parallelized by the reflective substrate at both sides of each passage to be emitted from the passage, wherein when one edge of the reflective structure is an inlet of the X-ray and the other edge is an outlet of the X-ray, a pitch of the reflective substrates at the outlet side is larger than a pitch at the inlet side, wherein the X-ray source and the reflective structure are disposed so as to reduce a penumbra amount formed by the X-ray emitted from each of the passages.

8. The X-ray optical apparatus according to claim 7, wherein the penumbra amount is a penumbra amount formed by an object when the X-ray emitted from the passage is irradiated onto the object.

9. The X-ray optical apparatus according to claim 7, wherein the penumbra amount is a penumbra amount formed by a one-dimensional grating when the X-ray emitted from the passage is irradiated onto the one-dimensional grating.

10. The X-ray optical apparatus according to claim 7, wherein when the X-ray emitted from the passage is irradiated onto a first one-dimensional grating and a second one-dimensional grating which are disposed in order from the outlet side of the reflective structure, the penumbra amount is a value estimated based on an interval of moiré stripes of the X-ray formed by the two one-dimensional gratings.

11. The X-ray optical apparatus according to claim 7, wherein the penumbra amount is a value estimated based on an intensity of the X-ray which passes through a solar slit when the X-ray emitted from the passage is irradiated onto the solar slit.

12. The X-ray optical apparatus according to claim 7, wherein in a state where a one-dimensional grating that allows the X-ray to be incident into only a specific passage is disposed between the X-ray source and the reflective structure, the penumbra amount is a value estimated based on a size of the X-ray emitted from the specific passage.

* * * * *